US012016416B2

(12) United States Patent
Zarate

(10) Patent No.: US 12,016,416 B2
(45) Date of Patent: Jun. 25, 2024

(54) WATER DISPENSING HAT

(71) Applicant: Luis Zarate, Kailua-Kona, HI (US)

(72) Inventor: Luis Zarate, Kailua-Kona, HI (US)

( * ) Notice: Subject to any disclaimer, the term of this patent is extended or adjusted under 35 U.S.C. 154(b) by 96 days.

(21) Appl. No.: 17/729,288

(22) Filed: Apr. 26, 2022

(65) Prior Publication Data

US 2022/0378136 A1 Dec. 1, 2022

Related U.S. Application Data

(60) Provisional application No. 63/193,134, filed on May 26, 2021.

(51) Int. Cl.
*A42B 1/008* (2021.01)

(52) U.S. Cl.
CPC ..... *A42B 1/008* (2013.01)

(58) Field of Classification Search
CPC ..... A42B 1/008; A42B 3/048
See application file for complete search history.

(56) References Cited

U.S. PATENT DOCUMENTS 2,560,215 A * 7/1951 Christensen ..... A62B 18/003 128/200.28
4,739,905 A * 4/1988 Nelson ..... A42B 1/24 D2/866
5,277,175 A * 1/1994 Riggs ..... A61M 16/0858 128/203.14
5,904,267 A * 5/1999 Thompson ..... B65D 81/3879 220/23.91
5,940,880 A * 8/1999 Phillips ..... A42B 3/048 222/401
5,957,964 A * 9/1999 Ceravolo ..... A61F 7/10 607/114
5,993,428 A * 11/1999 Hardge ..... A61M 11/02 604/294
6,050,099 A * 4/2000 Lopa ..... A61F 7/10 62/304
6,427,467 B1 * 8/2002 Bell ..... A42C 5/04 2/181.6
6,598,236 B1 * 7/2003 Gantt ..... A42B 1/008 2/DIG. 1
6,938,831 B1 * 9/2005 Brown ..... A42B 3/285 239/311
9,179,724 B1 * 11/2015 Schultz ..... A42B 3/048
10,952,487 B2 * 3/2021 Atkins ..... A42B 3/0406
(Continued)

*Primary Examiner* — Khaled Annis
(74) *Attorney, Agent, or Firm* — Boudwin Intellectual Property Law, LLC; Daniel Boudwin

(57) ABSTRACT

A water dispensing hat is provided. The device includes a hat member having a crown portion and a bill affixed along a front edge of the crown portion. A pair of reservoirs are affixed to an upper side of the crown portion on opposing lateral sides thereof, wherein each reservoir includes an inlet providing access to an interior volume. Tubing extends from each reservoir to a lower edge of the crown portion, wherein the tubing is in fluid communication with the interior volume. The tubing terminates in a dispenser housing affixed to a lateral edge of the bill, wherein each dispenser housing includes a nozzle on an interior side and a button on an exterior side. The nozzle is in fluid communication with the tubing and the associated reservoir. Upon actuation of the button, fluid disposed within the associated reservoir passes through the tubing and is disposed through the nozzle.

19 Claims, 5 Drawing Sheets

(56) References Cited

U.S. PATENT DOCUMENTS

| | | | | |
|---|---|---|---|---|
| 11,193,680 | B1 * | 12/2021 | Caballero | F24F 6/14 |
| 2004/0055072 | A1 * | 3/2004 | Lee | A41D 13/0053 2/171 |
| 2004/0128747 | A1 * | 7/2004 | Bumbarger | A45F 3/20 2/458 |
| 2006/0112707 | A1 * | 6/2006 | Tu | A42B 1/008 62/304 |
| 2007/0114301 | A1 * | 5/2007 | Blake | A45F 3/16 239/152 |
| 2008/0222777 | A1 * | 9/2008 | Schneider | A42B 1/008 2/209.13 |
| 2014/0303699 | A1 * | 10/2014 | Wahl | A61F 7/02 607/110 |
| 2014/0318154 | A1 * | 10/2014 | Kobayashi | F25D 7/00 62/3.5 |
| 2015/0273502 | A1 * | 10/2015 | Bell | B05B 9/0816 239/153 |
| 2018/0042327 | A1 * | 2/2018 | Taylor | A61F 7/10 |
| 2019/0090572 | A1 * | 3/2019 | Atkins | A42B 3/048 |
| 2020/0129709 | A1 * | 4/2020 | Ky | A61M 11/005 |
| 2021/0045483 | A1 * | 2/2021 | Yeh | A42B 1/008 |
| 2021/0197048 | A1 * | 7/2021 | Atkins | B67D 1/0802 |
| 2021/0352974 | A1 * | 11/2021 | Kirchmeier | A41D 13/005 |
| 2022/0117343 | A1 * | 4/2022 | Coffman | A42B 1/008 |
| 2022/0378136 | A1 * | 12/2022 | Zarate | A42B 1/008 |

* cited by examiner

WATER DISPENSING HAT

CROSS REFERENCE TO RELATED APPLICATIONS

This application claims the benefit of U.S. Provisional Application No. 63/193,134 filed on May 26, 2021. The above identified patent application is herein incorporated by reference in its entirety to provide continuity of disclosure.

BACKGROUND OF THE INVENTION

The present invention relates to hats with a cooling mechanism. More particularly, the present invention pertains to a hat having a water dispensing system to spray water towards a face of the wearer to facilitate cooling.

Many individuals spend extended periods of time outdoors, often in significant heat, which can lead to heat stroke or other harmful effects of overheating. Often, individuals wear hats to cover and shade their head and face to reduce heat incidence, however such precautions may not be sufficient to prevent overheating. Often, individuals use additional tools to cool themselves, such as handheld fans, misters, or the like, however, such devices may be cumbersome to carry and use, as they often require constant use of a hand. Alternatively, external means of cooling off are often used to curtail the effects of overheating, such as watering stations, drinking fountains, or moving indoors to an air-conditioned space, however such amenities may not be available in many locations. Furthermore, children are particularly susceptible heat stroke as they may be resistant to wearing protective clothing or using cooling devices. Therefore, a device that can aid in keeping the wearer cool during high heat conditions, while also being appealing to children to ensure its use is desired.

In light of the devices disclosed in the known art, it is submitted that the present invention substantially diverges in design elements from the known art and consequently it is clear that there is a need in the art for an improvement to existing cooling hats. In this regard, the instant invention substantially fulfills these needs.

SUMMARY OF THE INVENTION

In view of the foregoing disadvantages inherent in the known types of cooling hats now present in the known art, the present invention provides a water dispensing hat wherein the same can be utilized for providing convenience for the user when spraying water towards a user's face to reduce overheating and facilitate rapid cooling.

The present system comprises a hat member having a crown portion and a bill affixed along a front edge of the crown portion. A pair of reservoirs are affixed to an upper side of the crown portion on opposing lateral sides thereof, wherein each reservoir comprises an inlet providing access to an interior volume. Tubing extends from each reservoir to a lower edge of the crown portion, wherein the tubing is in fluid communication with the interior volume. The tubing terminates in a dispenser housing affixed to a lateral edge of the bill. Each dispenser housing comprises a nozzle on an interior side thereof and a button on an exterior side thereof, wherein the nozzle is in fluid communication with the tubing and the associated reservoir. Upon actuation of the button, fluid disposed within the associated reservoir passes through the tubing and is dispensed from the nozzle. In some embodiments, the button is operably connected to an electric pump disposed within each reservoir, wherein the electric pump continuously dispenses fluid through the tubing and the nozzle when the button is actuated.

In some embodiments, a cap is removably securable to a neck extending from the inlet of each reservoir. In another embodiment, threading is disposed on an exterior surface of the neck, the threading configured to engage complementary threading disposed on an interior surface of the cap. In other embodiments, the dispenser housing comprises a clip having a central groove disposed between the interior side and the exterior side, wherein the bill is frictionally engaged within the central groove. In yet another embodiment, a lower end of each reservoir is arcuate to conform to a curvature of the crown portion. In some embodiments, an upper end of each reservoir comprises a rounded shape. In another embodiment, the tubing is affixed to the lower edge of the crown portion and extends along the lateral edge of the bill, such that the tubing conforms to a perimeter of the hat. In other embodiments, each nozzle is disposed at an angle relative to the interior side, such that the nozzle is directed rearwardly towards the crown portion. In yet another embodiment, each nozzle further comprises a diffuser thereon, wherein the diffuser is configured to disperse the fluid dispensed from the nozzle into a mist. In some embodiments, the button comprises a manual pump configured to dispense an amount of fluid through the nozzle upon actuation.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
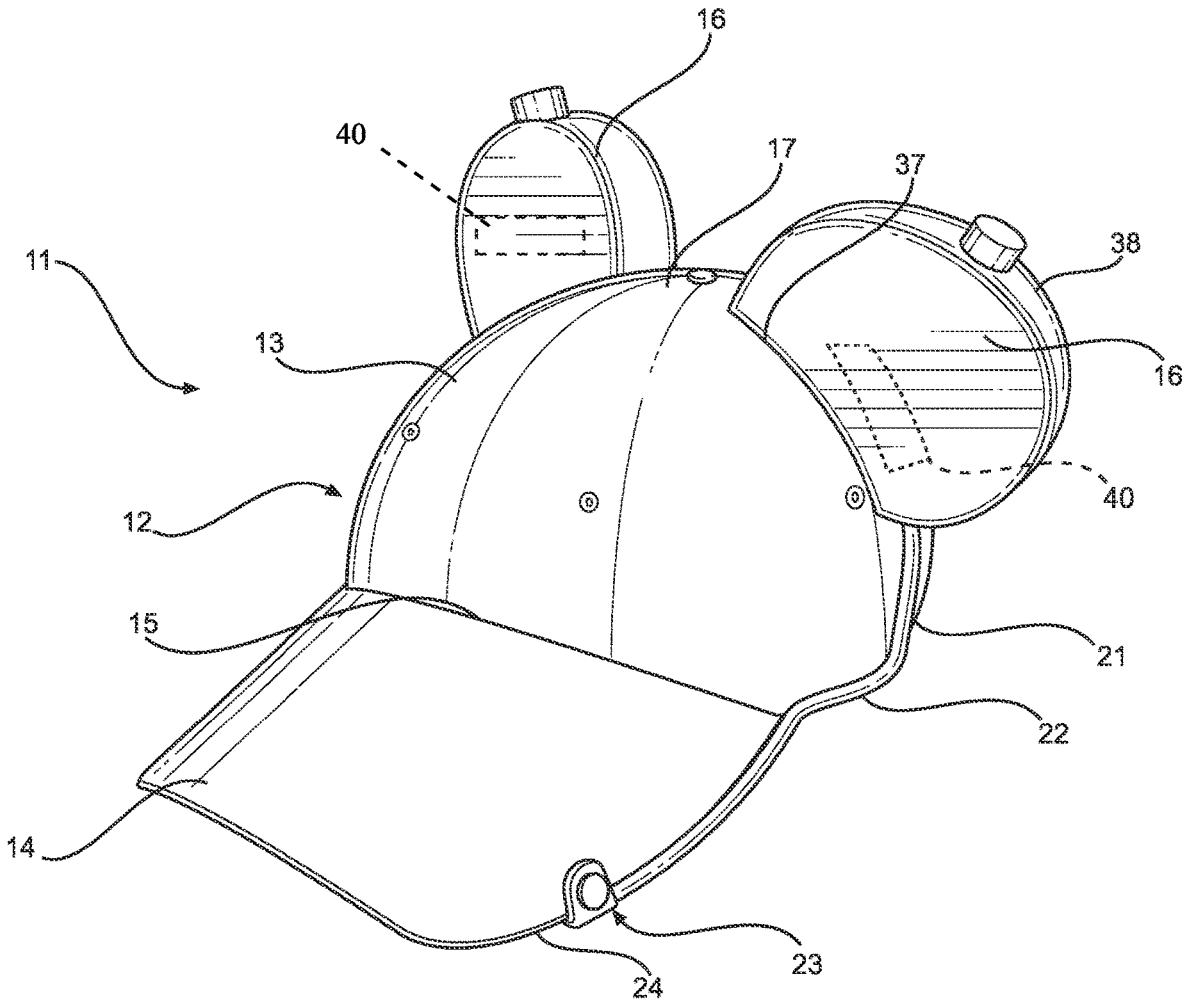
FIG. 1 shows a perspective view of an embodiment of the water dispensing hat.

Reference is made herein to the attached drawings. Like reference numerals are used throughout the drawings to depict like or similar elements of the water dispensing hat. The figures are intended for representative purposes only and should not be considered to be limiting in any respect.

Figure 3A:
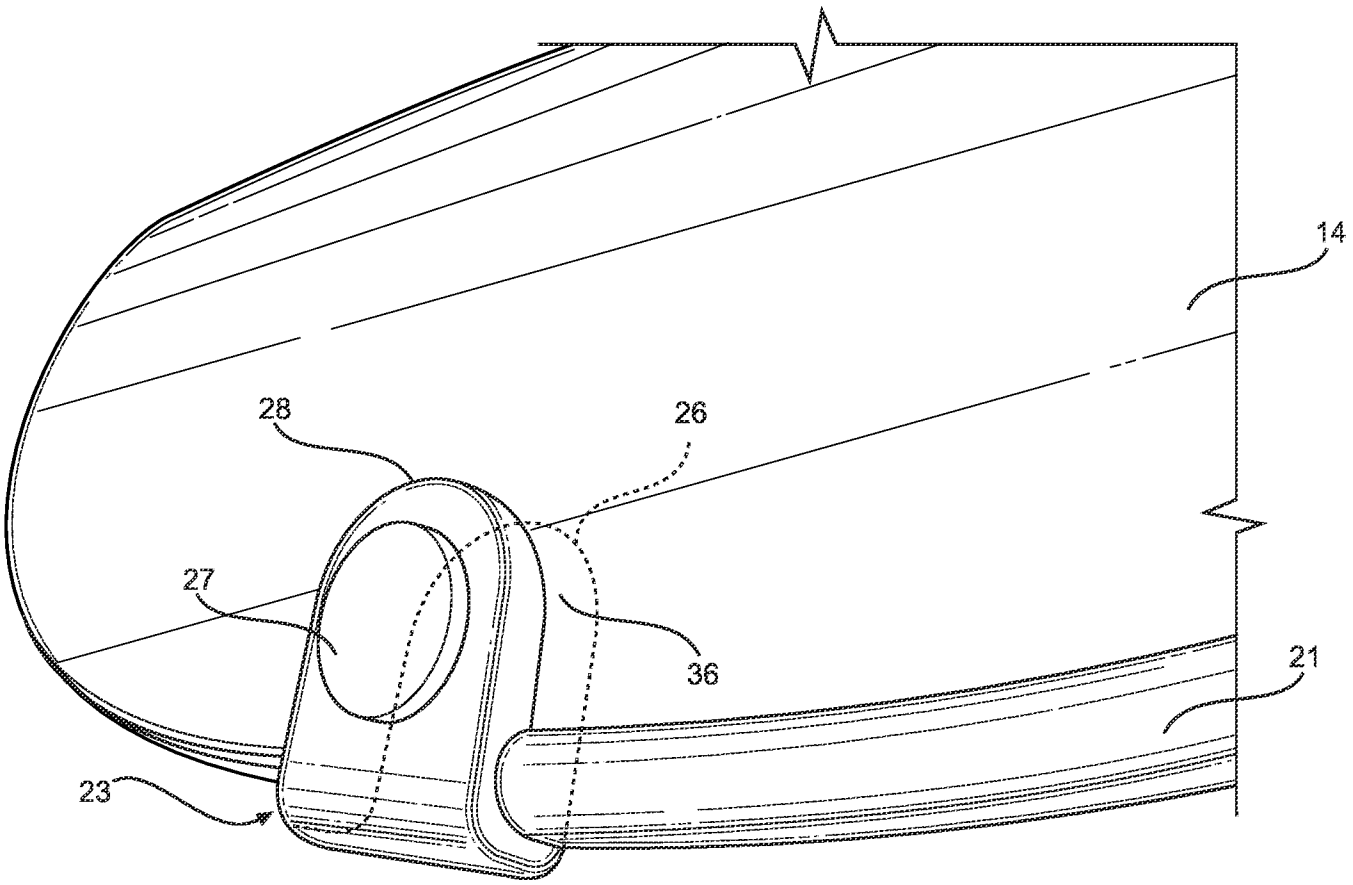
FIG. 3A shows a perspective view of the exterior side of the dispenser housing of an embodiment of the water dispensing hat.
Figure 3B:
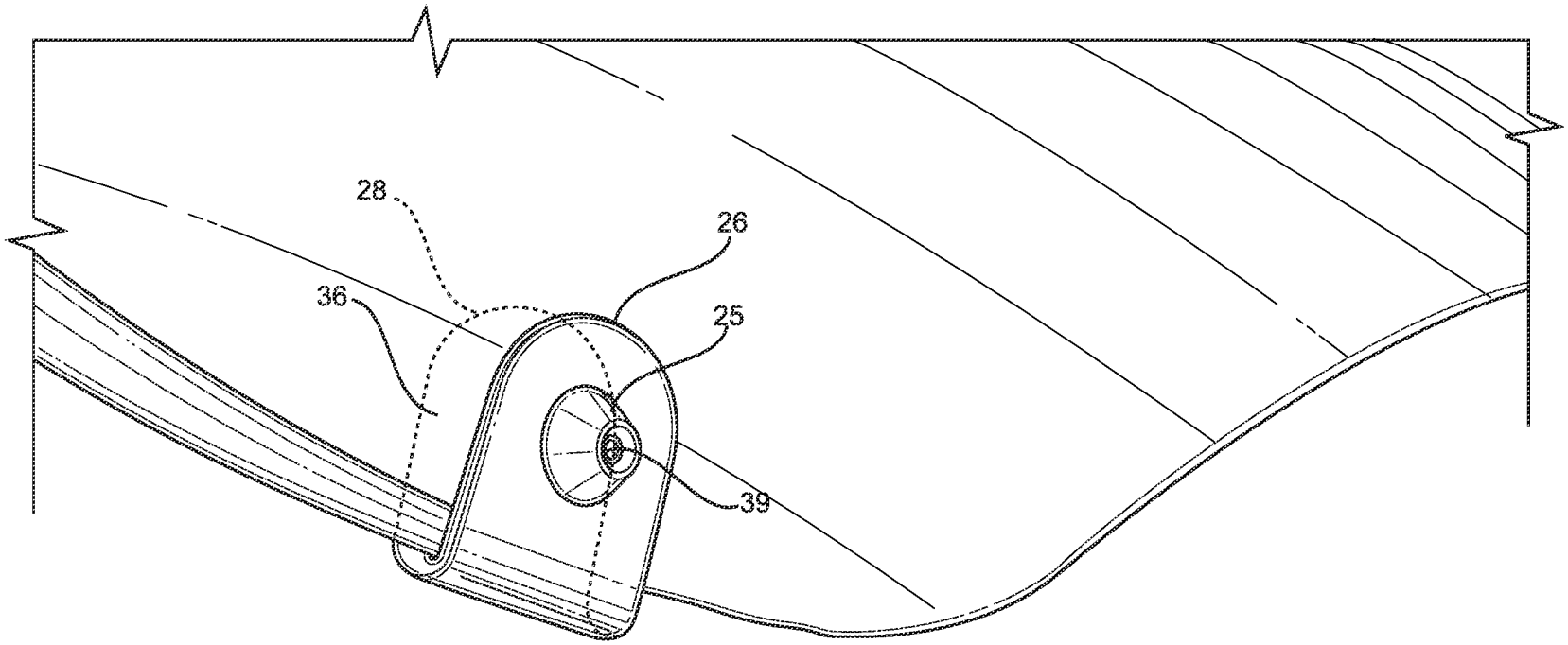
FIG. 3B shows a perspective view of the interior side of the dispenser housing of an embodiment of the water dispensing hat.

Referring now to FIG. 1, there is shown a perspective view of an embodiment of the water dispensing hat. The water dispensing hat 11 comprises a hat member 12 having a crown portion 13 affixed to a bill 14 along a front edge 15 of the crown portion 13. The bill 14 is contemplated to be flexible and capable of shape retention, such that the user can selectively adjust a position of the lateral edges of the bill 14 as desired to direct a nozzle (as shown in FIG. 3B, 25) towards a wearer's face as elsewhere described herein. A pair of reservoirs 16 are affixed to an upper side 17 of the crown portion 13, wherein the pair of reservoirs 16 define an interior volume configured to retain a fluid therein. In the illustrated embodiment, the pair of reservoirs 16 comprise a rounded upper end 38, such that the pair of reservoirs 16 resemble mouse ears to provide greater entertainment value to a wearer, however, in alternate embodiments, the upper end 38 is contemplated to be dimensioned to replicate alternate ear shapes or structures, such as cat ears, rabbit ears, or the like, so as to provide variety and customizability to the user. In the shown embodiment, a lower end 37 of the pair of reservoirs 16 is arcuate, such that the lower end 37 contours to the curvature of the crown portion 13 to facilitate maximal contact with the crown portion for stability. In some embodiments, the pair of reservoirs 16 comprise a singular reservoir structure connected together via a central connection extending over the upper side 17 of the crown portion 13 for added volume and stability. In some embodiments, the pair of reservoirs 16 are removably securable to the crown portion 13, such that the user can selectively affix the pair of reservoirs 16 to various distinct hat members 12 as desired, however, in alternate embodiments, the pair of reservoirs 16 are integrally affixed to the crown portion 13. In such embodiments, a fastener is affixed to the lower end 37 of each of the pair of reservoirs 16, wherein the fastener removably secures the lower end 37 to the crown portion 13.

Tubing 21 extends from each reservoir of the pair of reservoirs 16 and is in fluid communication with the interior volume of the associated reservoir. The tubing 21 terminates in a dispenser housing 23 affixed to the bill 14 of the hat member 12, such that the dispenser housing 23 is in fluid communication with the tubing 21 and the interior volume of each reservoir. In the illustrated embodiment, the tubing 21 extends linearly from the reservoir to a lower edge 22 of the crown portion 13, whereupon the tubing 21 continues along a perimeter of the crown portion 13 and along a lateral edge 24 of the bill 14. In this manner, the tubing 21 rests flush against and mimics the contours of the hat member 12 along an entirety of the tubing 21 to prevent unintended damage to the tubing 21 or contact with obstacles in the surrounding area. The dispenser housing 23 is contemplated to dispense fluid from the interior volume of each reservoir towards the face of a wearer of the hat member 12, such that the user can be temperature controlled via evaporative cooling. In the shown embodiment, an electric pump 40 is disposed within each reservoir of the pair of reservoirs 16, wherein the electric pump 40 activates upon actuation of a button (as shown in FIG. 3A, 27) to drive fluid from the interior volume through the tubing 21 and out of the nozzle. In such embodiments, the electric pump 40 is contemplated to continuously operate while the button is depressed, allowing a continuous spray of fluid from the nozzle as long as desired by the user. Alternatively, as further described elsewhere herein, the fluid can be manually pumped from the associated reservoir via intermittent actuation of the button to reduce complexity of design and reduce the risk of failure. In some embodiments, the tubing 21 and dispenser housing 23 are removably securable to the hat member 12, such that the user can selectively affix the tubing 21 and the dispenser housing 23 to various distinct hat members 12 as desired, however, in alternate embodiments, the tubing 21 and the dispenser housing 23 are integrally affixed to the hat member 12. In such removable embodiments, a fastener extends along an entire length of the tubing 21 to removably secure the tubing 21 to the crown portion 13 and along the lower edge 22 of the crown portion 13 and the lateral edge 24 of the bill 14. Similarly, the dispenser housing 23 can be removably secured to the lateral edge 24 of the bill 14 as elsewhere described herein.

Figure 2:
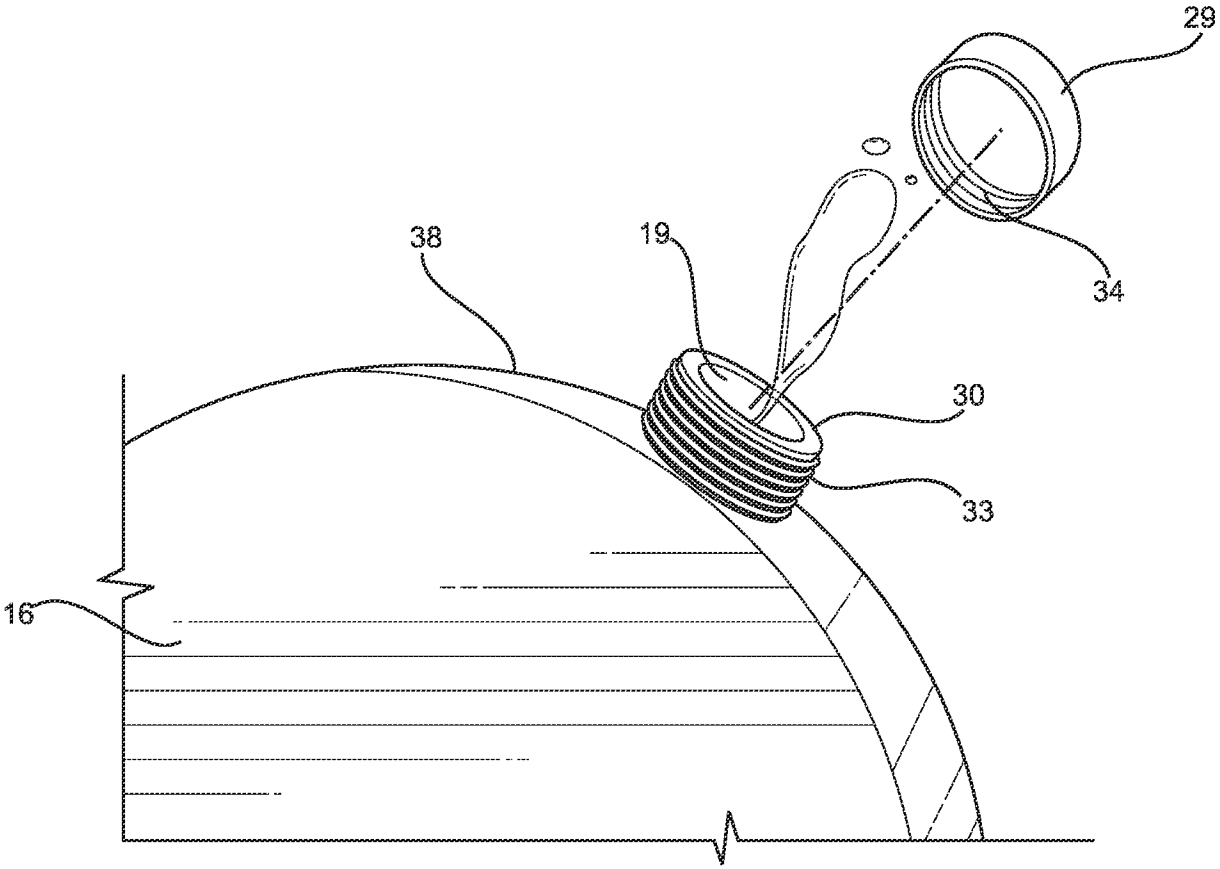
FIG. 2 shows an exploded view of the cap and inlet of an embodiment of the water dispensing hat.

Referring now to FIG. 2, there is shown an exploded view of the cap and inlet of an embodiment of the water dispensing hat. An inlet 19 is disposed through the upper end 38 of each reservoir of the pair of reservoirs 16, wherein the inlet 19 provides access to the interior volume to facilitate refilling or emptying each reservoir as desired. In the illustrated embodiment, a neck 30 extends from the upper end 38 about the inlet 19, wherein the neck 30 removably receives a cap 29 thereon. In some embodiments, the cap 29 removably secures to the neck 30 via frictional engagement, however, in the shown embodiment, threading is disposed on an exterior surface 33 of the neck 30 and complementary threading is disposed on an interior surface 34 of the cap 29. In such embodiments, the threading engages the complementary threading of the cap 29 to removably secure the cap 29 thereto. In this manner, a watertight seal can be formed between the neck 30 and the cap 29, thereby ensuring the fluid stored within each reservoir of the pair of reservoirs 16 is retained therein. In some embodiments, the threading and complementary threading may be further supported by gaskets or the like to further ensure a watertight seal between the neck 30 and the cap 29.

Referring now to FIGS. 3A and 3B, there is shown a perspective view of the exterior side of the dispenser housing of an embodiment of the water dispensing hat and a perspective view of the interior side of the dispenser housing of an embodiment of the water dispensing hat, respectively. In the illustrated embodiment, the dispenser housing 23 comprises a clip structure having an interior side 26, an exterior side 28, and a central groove 36 therebetween, wherein the central groove 36 is configured to frictionally engage the bill 14 of the hat member therein to retain the dispenser housing 23 thereon. In the shown embodiment, the tubing 21 operably connects to the dispenser housing 23 along a lateral side of a base thereof between the interior and exterior sides 26, 28. A nozzle 25 is disposed on the interior side 26 of the dispenser housing 23, wherein the nozzle 25 is in fluid communication with the interior volume of the associated reservoir. In the illustrated embodiment, the nozzle 25 is oriented rearwardly relative to the bill 14 towards the crown portion. In this manner, the nozzle 25 is angled to dispense water towards the face of the wearer of the water dispensing hat. In the shown embodiment, a diffuser 39 is disposed on a distal end of the nozzle 25, wherein the diffuser 39 is configured to emit a fine mist to increase the surface area covered by the dispensed mist, while reducing the force of emission to provide a comfortable experience for the user. A button 27 is disposed on the exterior side 28 of the dispenser housing 23, wherein the button 27 is operably connected to the nozzle 25 and the tubing 21, whereupon actuation of the button 27, the nozzle 25 is configured to dispense fluid from the tubing 21 onto the face of the wearer. In some embodiments, the button 27 comprises a manual pump system, wherein actuation of the button 27 drives fluid from the tubing 21 through the nozzle 25 via increased air pressure. In this manner, mechanical energy transferred by the user in actuating the button 27 forces fluid to be dispensed upon actuation. Alternatively, the button 27 is contemplated to be operably connected to an electric pump system disposed within each reservoir of the pair of reservoirs, such that upon actuation of the button 27, the electric pump is activated driving fluid through the tubing 21 and the nozzle 25. In some such embodiments, the pump is configured to continuously drive fluid from the reservoirs through the nozzle 25 while the button 27 is actuated, ensuring a constant stream of water towards the face of the user. In this manner, less energy is expended by the user in dispensing water from the reservoirs.

Figure 4:
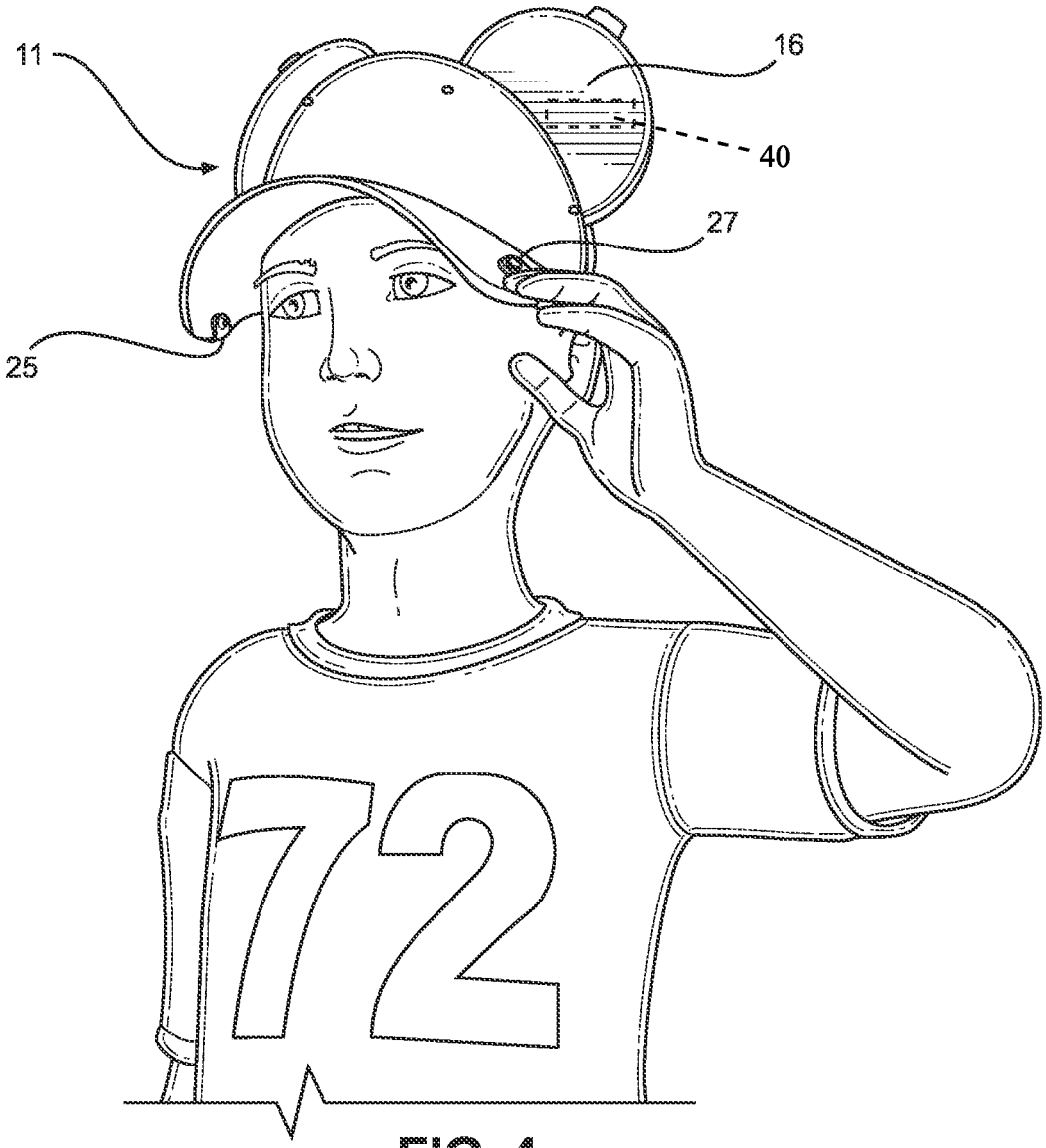
FIG. 4 shows a perspective view of an embodiment of the water dispensing hat in use.

Referring now to FIG. 4, there is shown a perspective view of an embodiment of the water dispensing hat in use. In one use, the water dispensing hat 11 is placed on the wearer's head after filling each reservoir of the pair of reservoirs 16 with water. In some embodiments, the pair of reservoirs 16 and the associated tubing and dispenser housing may be removably secured to an existing hat member, such that the user can accessorize or customize an existing hat to provide water cooling properties. Similarly, the removable embodiment provides the user with the ability to customize the pair of reservoirs 16 in use to fit a desired theme, such as wearing mouse or cat ear shaped reservoirs to represent a character associated with a particular outdoor event. As the user begins to feel overheated, the user can depress the button 27 disposed on the dispenser housing to pump fluid from the interior volume of the associated reservoir through the nozzle 25, such that water is sprayed towards the face of the user. In some embodiments, the nozzle 25 is directed towards the user's face, such that even in a stationary position, the water dispensed therefrom contacts the user's face, however, in alternate embodiments, the user may direct the water into the path of the user's movement such that a mist is produced in front of the user, which the user then walks into. Similarly, in such embodiments, the bill of the hat member may be adjusted to orient each nozzle 25 more directly in a desired direction to provide additional control over the flow of fluid from the nozzles 25. In this manner, the water dispensing hat 11 can aid in evaporative cooling of the user to prevent overheating, while also being engaging and enjoyable for children.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly, and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A water dispensing hat, comprising:

a hat member having a crown portion and a bill affixed along a front edge of the crown portion;

a pair of reservoirs affixed to an upper side of the crown portion on opposing lateral sides thereof, wherein each reservoir comprises an inlet providing access to an interior volume;

tubing extending from each reservoir to a lower edge of the crown portion, wherein the tubing is in fluid communication with the interior volume of an associated reservoir;

wherein the tubing terminates in a dispensing housing affixed to a lateral edge of the bill;

wherein each dispenser housing comprises a nozzle on an interior side thereof and a button on an exterior side thereof;

wherein the nozzle is in fluid communication with the tubing and the associated reservoir;

whereupon actuation of the button, fluid disposed within the associated reservoir passes through the tubing and is dispensed from the nozzle.

2. The water dispensing hat of claim 1, further comprising a cap removably securable to a neck extending from the inlet of each reservoir.

3. The water dispensing hat of claim 2, wherein threading is disposed on an exterior surface of the neck, the threading configured to engage complementary threading disposed on an interior surface of the cap.

4. The water dispensing hat of claim 1, wherein the dispenser housing comprises a clip having a central groove disposed between the interior side and the exterior side, wherein the bill is frictionally engaged within the central groove.

5. The water dispensing hat of claim 1, wherein a lower end of each reservoir is arcuate to conform to a curvature of the crown portion.

6. The water dispensing hat of claim 1, wherein an upper end of each reservoir comprises a rounded shape.

7. The water dispensing hat of claim 1, wherein the tubing is affixed to the lower edge of the crown portion and extends along the lateral edge of the bill, such that the tubing conforms to a perimeter of the hat.

8. The water dispensing hat of claim 1, wherein each nozzle is disposed at an angle relative to the interior side, such that the nozzle is directed rearwardly towards the crown portion.

9. The water dispensing hat of claim 1, wherein each nozzle further comprises a diffuser thereon, wherein the diffuser is configured to disperse the fluid dispensed from the nozzle into a mist.

10. The water dispensing hat of claim 1, wherein the button comprises a manual pump configured to dispense an amount of fluid through the nozzle upon actuation.

11. A water dispensing hat, comprising:

a hat member having a crown portion and a bill affixed along a front edge of the crown portion;

a pair of reservoirs affixed to an upper side of the crown portion on opposing lateral sides thereof, wherein each reservoir comprises an inlet providing access to an interior volume;

tubing extending from each reservoir to a lower edge of the crown portion, wherein the tubing is in fluid communication with the interior volume of an associated reservoir;

wherein the tubing terminates in a dispensing housing affixed to a lateral edge of the bill;

wherein each dispenser housing comprises a nozzle on an interior side thereof and a button on an exterior side thereof;

wherein the nozzle is in fluid communication with the tubing and the associated reservoir;

wherein the button is operably connected to an electric pump disposed within each reservoir;

wherein the electric pump continuously dispenses fluid through the tubing and the nozzle when the button is actuated.

12. The water dispensing hat of claim 11, further comprising a cap removably securable to a neck extending from the inlet of each reservoir.

13. The water dispensing hat of claim 12, wherein threading is disposed on an exterior surface of the neck, the threading configured to engage complementary threading disposed on an interior surface of the cap.

14. The water dispensing hat of claim 11, wherein the dispenser housing comprises a clip having a central groove disposed between the interior side and the exterior side, wherein the bill is frictionally engaged within the central groove.

15. The water dispensing hat of claim 11, wherein a lower end of each reservoir is arcuate to conform to a curvature of the crown portion.

16. The water dispensing hat of claim 11, wherein an upper end of each reservoir comprises a rounded shape.

17. The water dispensing hat of claim 11, wherein the tubing is affixed to the lower edge of the crown portion and extends along the lateral edge of the bill, such that the tubing conforms to a perimeter of the hat.

18. The water dispensing hat of claim 11, wherein each nozzle is disposed at an angle relative to the interior side, such that the nozzle is directed rearwardly towards the crown portion.

19. The water dispensing hat of claim 11, wherein each nozzle further comprises a diffuser thereon, wherein the diffuser is configured to disperse the fluid dispensed from the nozzle into a mist.

* * * * *